US005477663A

United States Patent [19]

Smith et al.

[11] Patent Number: 5,477,663

[45] Date of Patent: Dec. 26, 1995

[54] ROBOTIC TRAY LOADER SYSTEM, METHOD AND APPARATUS

[75] Inventors: Bruce D. Smith, West Chester, Pa.; William J. Covert, Berlin, N.J.; Edward F. Vander Bush, Downingtown, Pa.; Roy B. Melton, Pottstown, Pa.; Paul W. Sirgenson, Schwenksville, Pa.; Frank C. Tammaro, Phoenixville, Pa.; Bernard F. Sykes, Mont Clare, Pa.; Eric Shoup, Manalapan, N.J.; J. Donald Birtwell, Pottstown; Thomas A. Stalnaker, West Chester, both of Pa.

[73] Assignee: The West Company, Lionville, Pa.

[21] Appl. No.: 18,094

[22] Filed: Feb. 17, 1993

[51] Int. Cl.[6] ..... B65B 5/10

[52] U.S. Cl. ..... 53/475; 53/244; 53/251; 53/448; 53/534

[58] Field of Search ..... 53/534, 448, 444, 53/443, 543, 244, 251, 253, 475, 473

[56] References Cited

U.S. PATENT DOCUMENTS

| | | | |
|---|---|---|---|
| 2,938,315 | 5/1960 | Voullaire | 53/543 X |
| 3,283,471 | 11/1966 | Thurston et al. | 53/534 X |
| 3,453,804 | 7/1969 | Taylor et al. | 53/543 X |
| 4,713,926 | 12/1987 | Mennie et al. | 53/251 X |
| 4,932,191 | 6/1990 | Wild | 53/534 X |

*Primary Examiner*—James F. Coan
*Attorney, Agent, or Firm*—Eugene E. Renz, Jr.

[57] ABSTRACT

In a system for transferring groups of containers from one location to another, a loading station including a transfer mechanism for continuously delivering rows of containers from the transfer station to a tray loading station. A device at the tray loading station is included for cycling the tray in a predetermined controlled sequence to receive rows of containers delivered by the transfer mechanism and to position them in a compact array in the tray.

17 Claims, 14 Drawing Sheets

VIAL CONVEYOR $C_i$ (VIALS PRESENT)

TURRET ASSEMBLY
TURRET ARMS GRIPPER ASSEMBLYS
TURRET ROTATION

TRAY CONVEYOR COMPACTING & ADVANCE STROKE

ROBOTIC TRAY LOADER SYSTEM, METHOD AND APPARATUS

FIELD OF THE INVENTION

The present invention relates to a system, method and apparatus for transferring containers, such as vials for pharmaceutical products, from one location to another in a high speed processing environment. More specifically, the invention relates to improvements in automatic handling of vials and transferring them from an accumulator location and depositing them in a predetermined orientation in trays for further processing, such as sterilization.

BACKGROUND OF THE INVENTION

Automatic handling systems for vials containing pharmaceutical products are not new per se. There are a variety of known systems and apparatus for high speed, automated processing of vials for pharmaceutical products. For example, The West Company, Incorporated, assignee of the present application, has a line of equipment for automatic capping of pharmaceutical vials and equipment for washing and sterilizing vials at high production rates. However, there are still some operations which are done manually. For example, there is a line of test equipment for checking particulate matter and seal integrity where the vials are manually positioned in place during the test operation. In other instances, it may be necessary to manually place vials in special trays for certain processes, such as lyophilization or sterilization.

SUMMARY OF THE INVENTION

With the foregoing in mind, it is an object of the present invention to provide a system, method and apparatus for automatically transferring vials from one location to another at high speeds. For example, the present invention has useful application in those instances where, in the past, vials were manually transferred and placed in special trays for sterilization. Thus, the present invention consists broadly of an infeed conveyor system where vials are delivered single file to an accumulator station and then grouped in predetermined numbers by a series of cooperating, selectively adjustable, escapement mechanisms which can be selectively oriented to vary the number of vials segregated into groups. The system further includes a so-called "CAMBOT pick and place assembly" having a plurality of vial transfer mechanisms operable to pick up and transfer groups of vials from one location to another. CAMBOT is the trademark for a commercially available robotic motion machine which can be control led to produce predetermined axial and rotational repetitive cycles.

More specifically, the transfer mechanism comprises a turret and a plurality of radially outwardly directed, circumferentially spaced, gripper assemblies selectively positionable between open and closed positions to deliver rows of vials from a vial pickup station to a tray loading station in a predetermined controlled sequence as determined by the CAMBOT assembly.

In accordance with another feature of the present invention, the infeed assembly includes means for controlling grouping of the vials to provide a staggered array of rows of vials in the tray and thereby maximizes utilization of the tray space. More specifically, the escapement gate nearest the transfer mechanism has an escapement pin which locates the front vial in a group to be transferred at a further distance from the actuating mechanism than a dead stop in the infeed trackway. Thus, in the operation of the system, when the escapement pin is retracted, the vials entering the transfer station engage the dead stop every other cycle. This produces the desired staggered orientation of groups of vials delivered to the tray.

The system further includes a novel servo motor driven tray conveyor which advances a properly oriented empty tray to a "home" or vial loading position. As a row of vials is delivered to the tray, the tray conveyor reverses whereby the compactor blade of a pusher assembly engages the row of vials into a compact array against the front wall of the empty tray, or against the row of vials previously compacted. The tray conveyor continues to move in a reverse direction until resistance is sensed by the compactor blade signaling advance movement of the conveyor a predetermined distance to accommodate the next row of vials. The displaced distances traveled by the tray conveyor are accurately measured by an encoder and this information is delivered to a programmable logic circuit (PLC) to control proper cycling of the tray conveyor for vials of different types and sizes.

When a predetermined number of vials are delivered to the tray in rows in the manner described above to fill a given tray, the programmable logic circuit (PLC) signals the tray conveyor to discharge the filled tray from the tray loading station and advance the next empty tray to a home position at the loading station.

The filled trays are advanced by the tray conveyor until they rest on the rollers of the discharge conveyor. The filled trays are then free to coast gently down the discharge conveyors until engaging a stop.

The system also includes sensors associated with the discharge conveyor for signaling certain conditions which may interfere with normal operation. For example, two filled trays on the discharge conveyor produce an audible signal alerting the operator to move a tray but does not interfere with normal automatic operation of the system. If three filled trays are on the discharge conveyor, the system is automatically shut down to prevent damage to trays and vials. Additionally there are sensors along the tray conveyor adjacent the tray loading station to insure proper orientation and seating of the tray on the conveyor which in turn insures proper loading of the vials in the tray in the manner described above.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
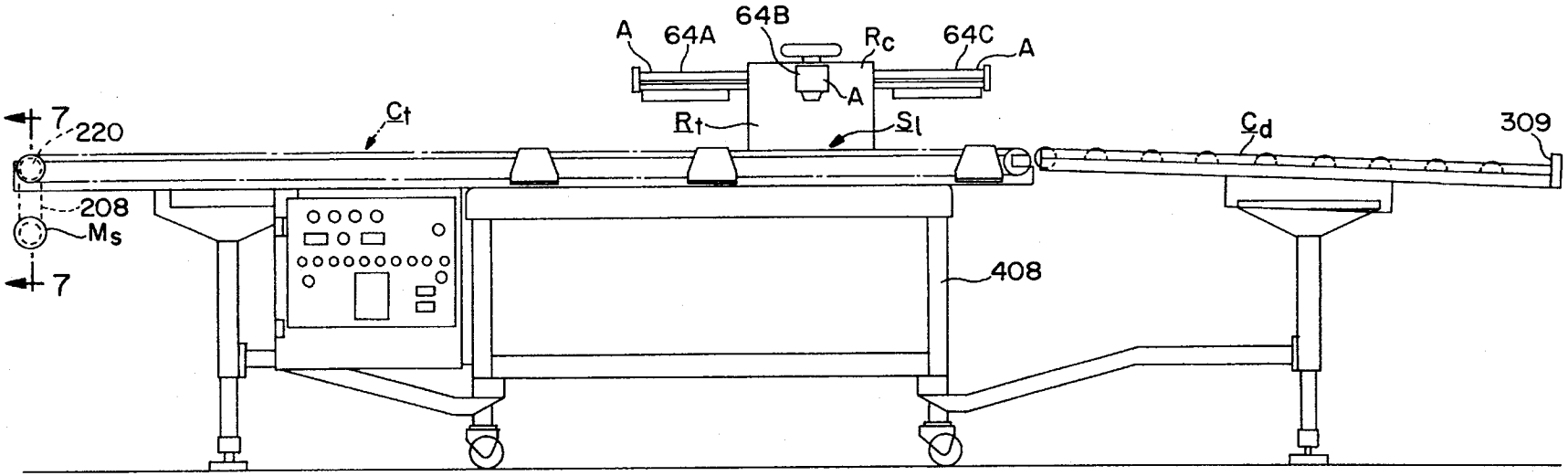
FIG. 1 is a semi-schematic side elevational view of the four arm robotic tray loader as viewed from the operator's side.
Figure 17A:
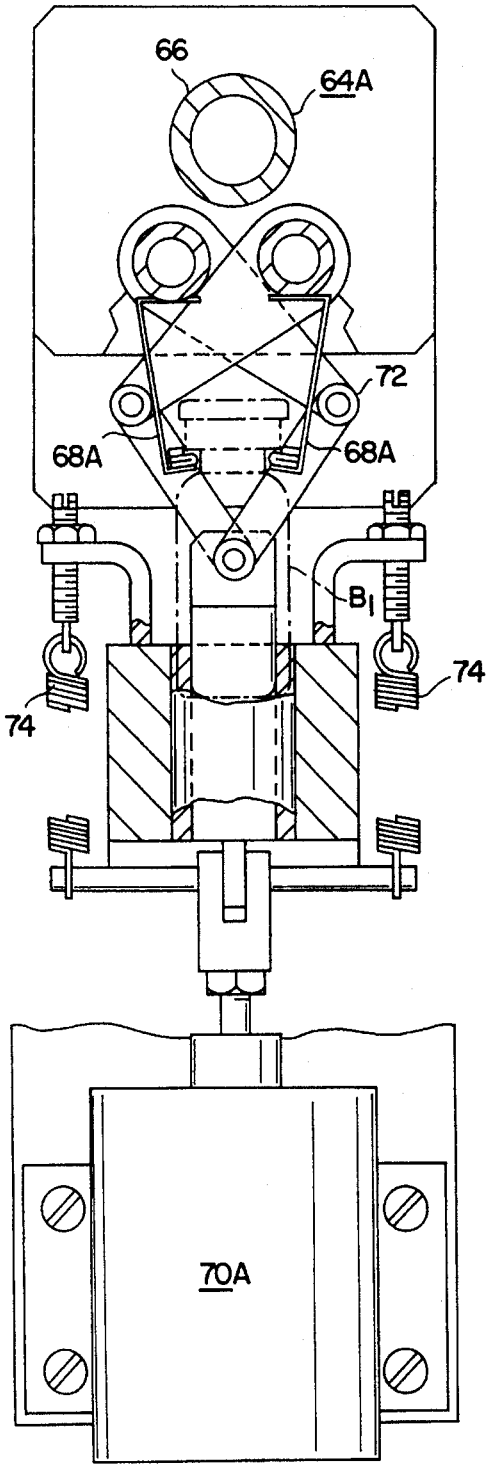
FIG. 17A is an enlarged fragmentary sectional elevational view taken on the line 17A—17A of FIG. 16 showing a solenoid actuated gripper mechanism in the de-energized or closed state securing a row of vials shown in dot and dash outline.
Figure 17B:
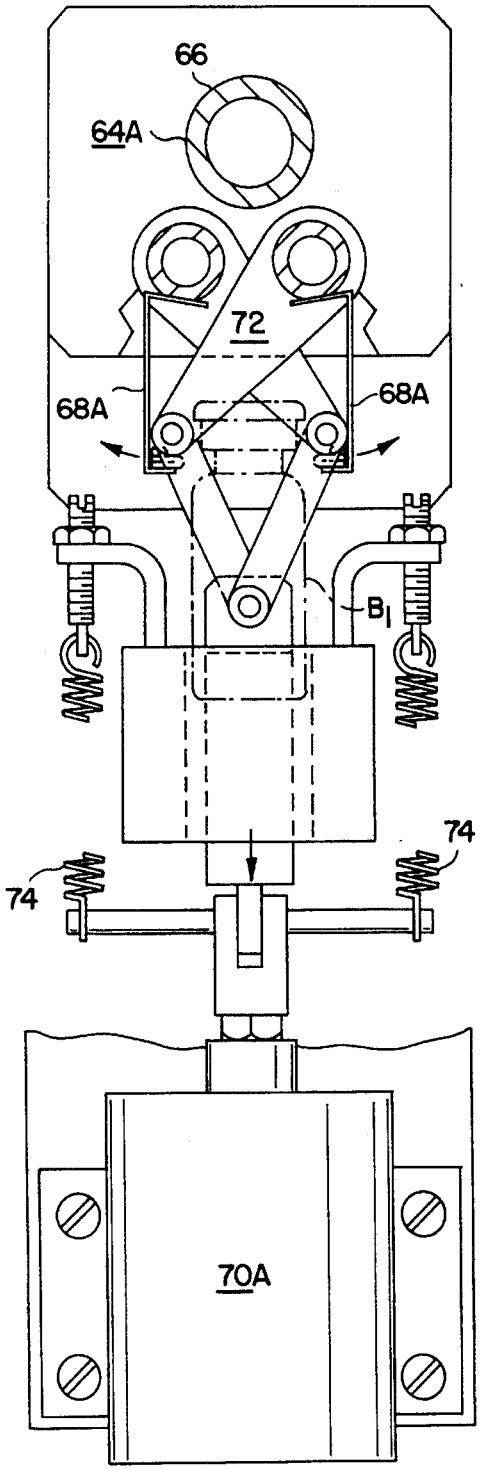
FIG. 17B is a view similar to FIG. 17A showing the solenoid actuated gripper mechanism in the energized or open state releasing a row of vials shown in dot and dash outline.
Figure 20:
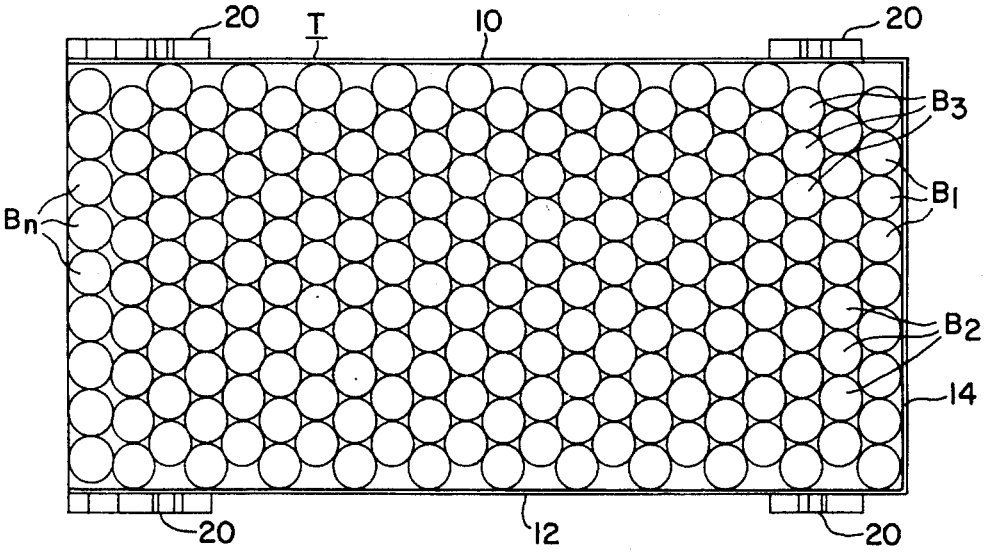
FIG. 20 is a plan view showing a filled compacted tray of vials.

For ease of understanding the method, system and apparatus of the present invention, it is desirable first to consider the broad details and arrangement of the system and how they function. Thus, the overall system, which is best shown and illustrated in FIGS. 1 and 2, comprises a vial infeed conveyor assembly $C_i$ which directs vials B to a vial transfer station $S_t$. A series of escapement mechanisms $M_e$ located along the path of the infeed conveyor assembly $C_i$ function to segregate groups of vials B into rows $B_1$, $B_2$, $B_n$ of a preselected number of vials for pick-up and transfer in a group or row by a CAMBOT pick and place assembly 62. The CAMBOT assembly 62 has a rotating turret 60 and a plurality of arms A, in the present instance four (4), having gripping jaw mechanisms operable between open and closed positions (See FIGS. 17A and 17B). The turret 60 rotates and reciprocates in a predetermined timed cycle to effect transfer of vials B from the vial transfer station $S_t$ to the tray loading station $S_l$. The system further includes a tray conveyor $C_t$ controlled to automatically position trays T at the loading station $S_l$ and cycle during the loading process to effect loading the rows of vials in the tray T in a compact nested array as shown in FIG. 20. Filled trays T are then moved to a discharge conveyor $C_d$ for manual processing.

Figure 8:
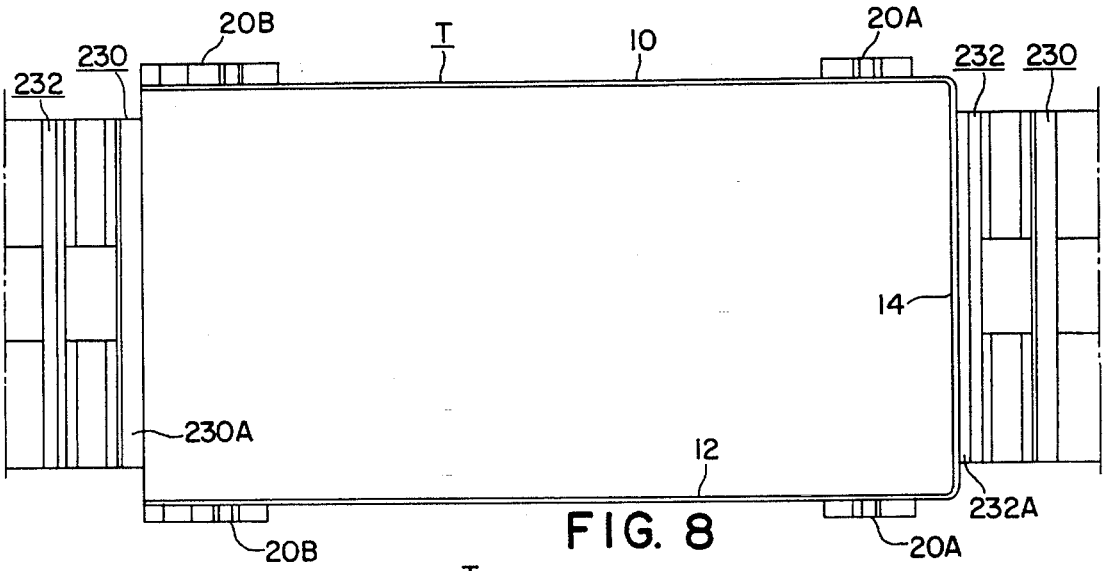
FIG. 8 is an enlarged fragmentary plan view taken on the line 8—8 of FIG. 3 showing details of an empty vial tray positioned on the tray conveyor belt between a pair of transversely extending cleats.
Figure 9:
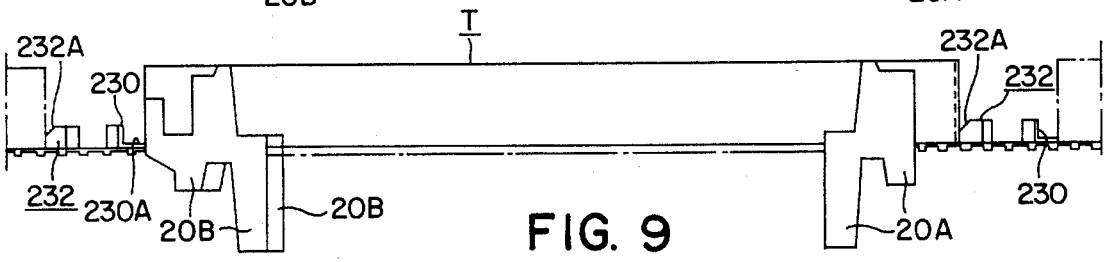
FIG. 9 is a side elevational view of the vial tray shown in FIG. 8 and showing additional details of a portion of the tray conveyor belt.
Figure 10:
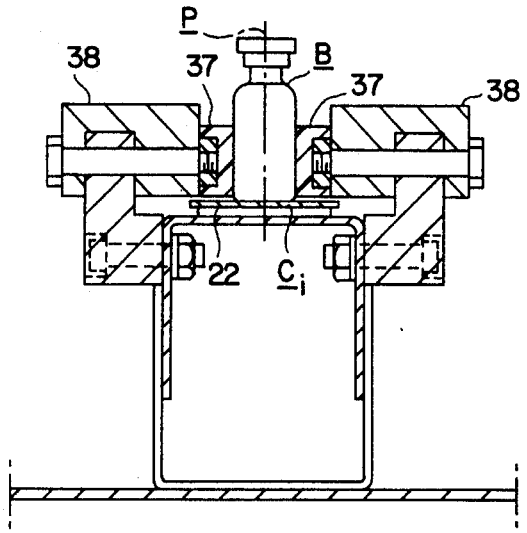
FIG. 10 is an enlarged fragmentary transverse sectional view taken on the line 10—10 of FIG. 5 showing additional details of the infeed vial conveyor assembly.
Figure 11:
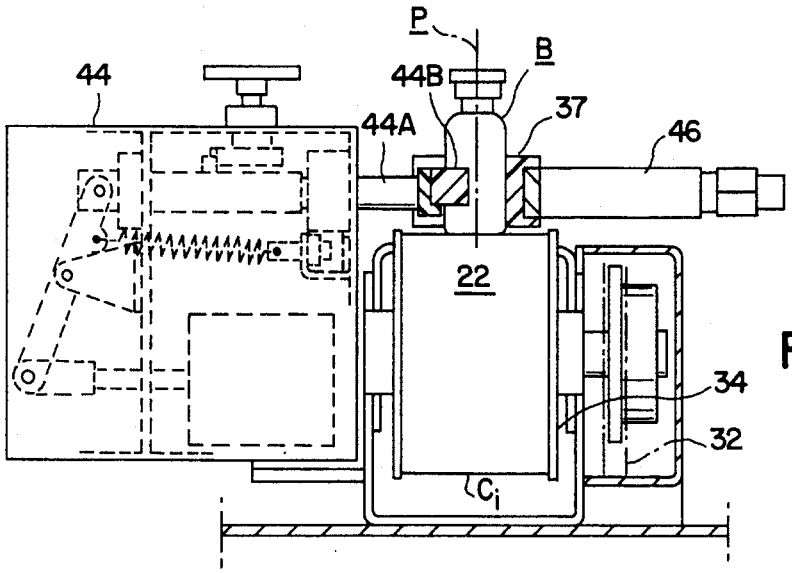
FIG. 11 is an enlarged fragmentary transverse sectional view taken on the line 11—11 of FIG. 5 showing details of a solenoid operated gate mechanism to segregate vials into groups.
Figure 12:
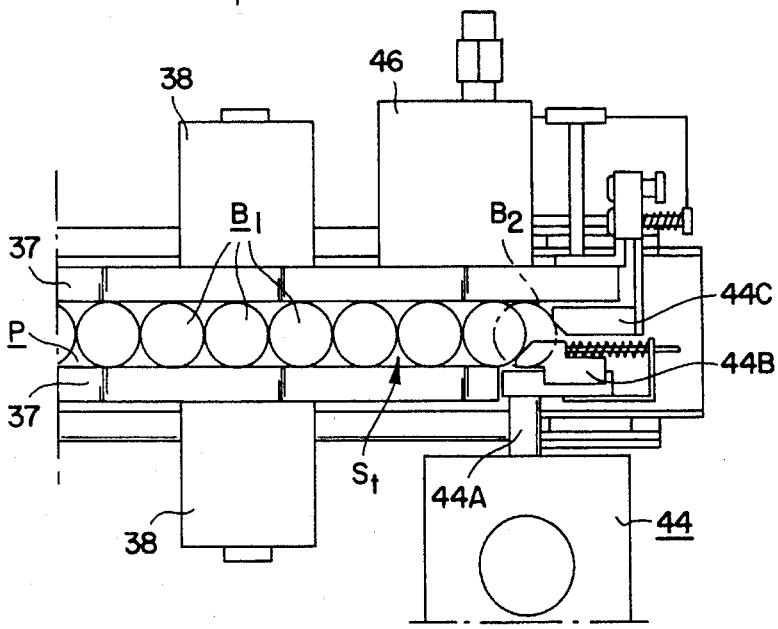
FIG. 12 is an enlarged fragmentary plan view of the detail contained within the dot and dash rectangle of FIG. 4 and designated FIG. 12 showing details of the solenoid operated gate mechanism used to stagger rows of vials at the vial pick up station.

There is shown in FIGS. 8 and 9 a tray configuration having a particular design providing certain operating functions in the system and apparatus of the present invention. The tray T is of a generally rectangular shape having opposing side walls 10 and 12 and front wall 14. The end of the tray T opposite the front wall is open. The open end of tray T is designed to receive a detachable end wall manually positioned in place after the tray has been filled in the manner described in more detail hereafter.

Figure 14:
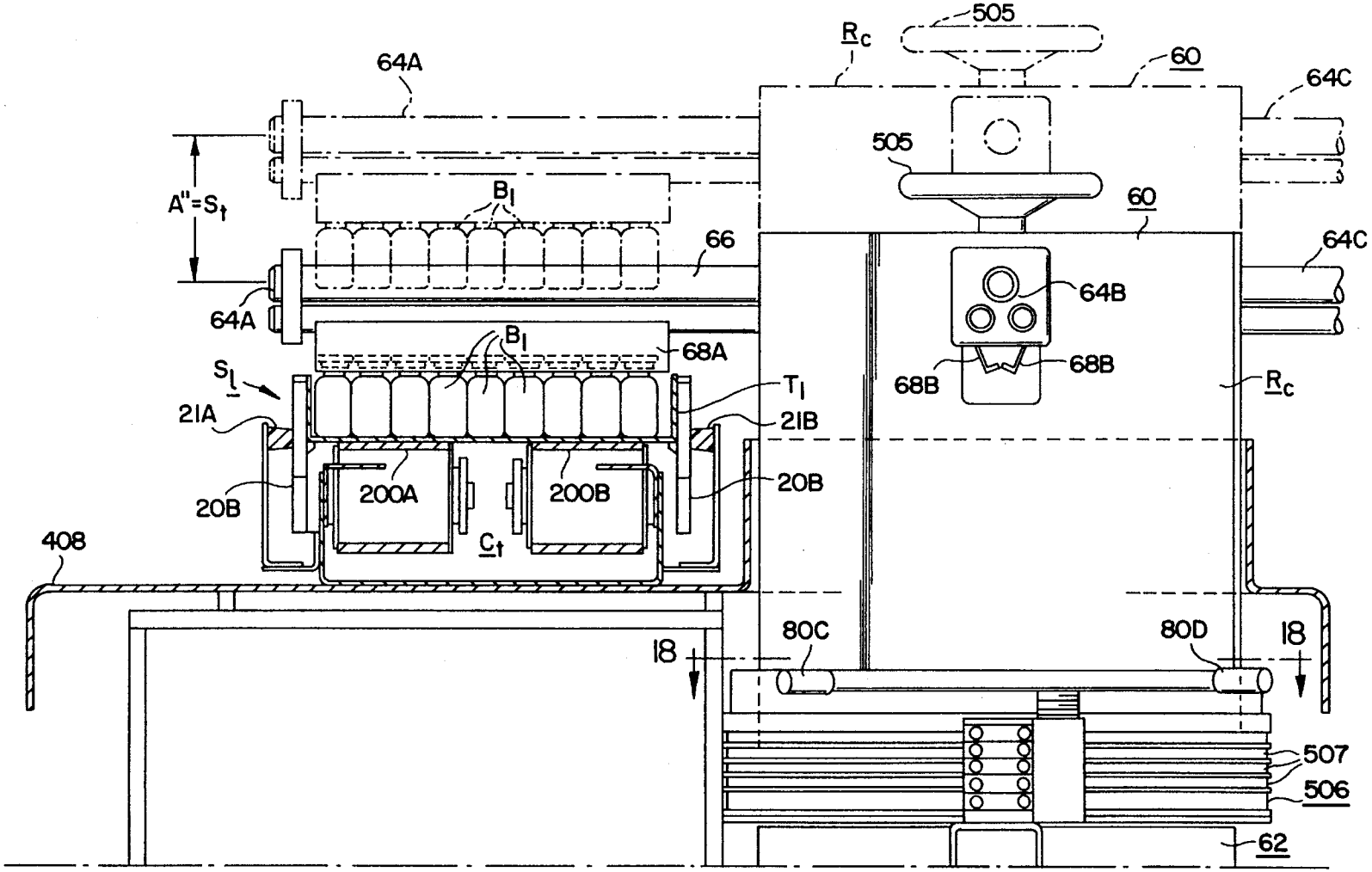
FIG. 14 is an enlarged fragmentary transverse sectional elevational view taken on the line 14—14 of FIG. 4 showing details of the tray conveyor, the turret assembly and a portion of the upper end of the CAMBOT device at the tray loading station.
Figure 15:
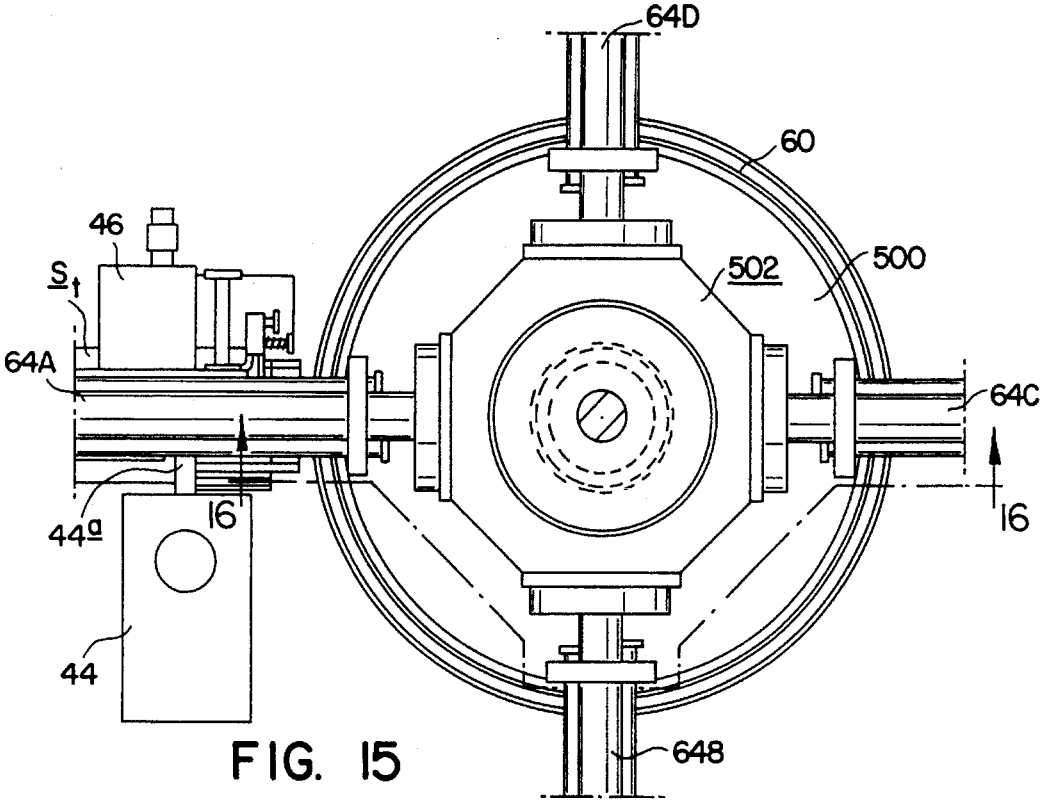
FIG. 15 is an enlarged fragmentary sectional plan view taken on the line 15—15 of FIG. 13 showing additional details of the four arm turret assembly.
Figure 16:
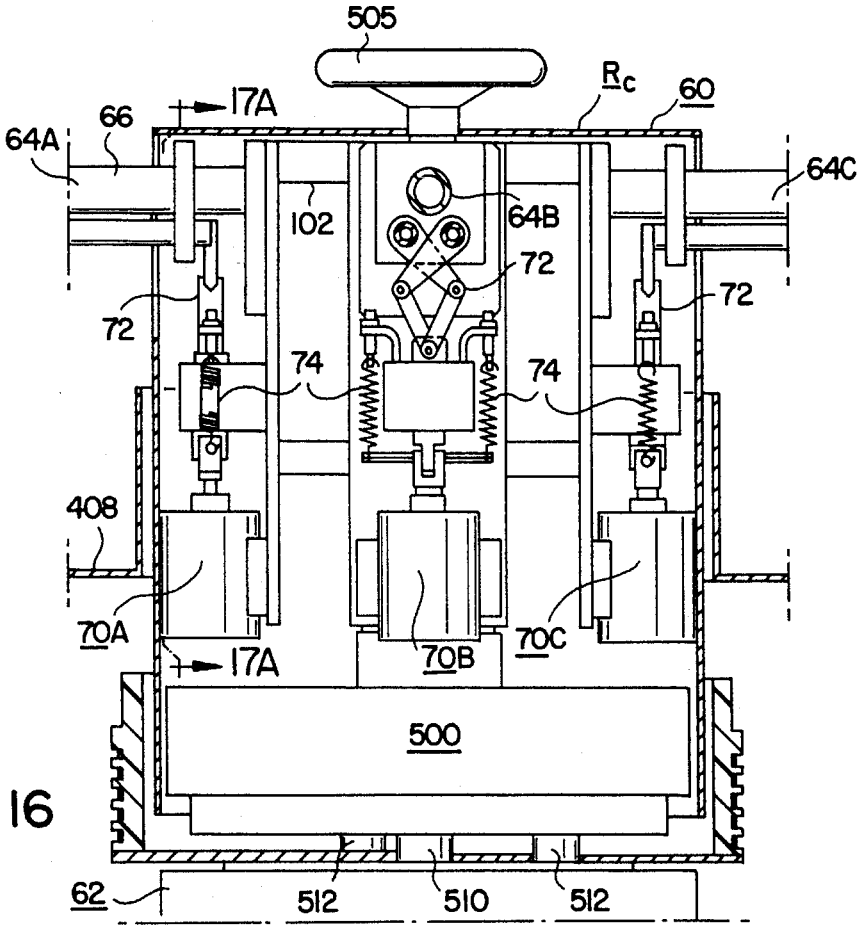
FIG. 16 is a sectional elevation view taken on the line 16—16 of FIG. 15 showing details of the solenoid actuated gripper assemblies for each of the turret.

The tray T further includes downwardly depending fingers adjacent the front wall 14 and open rear end of the tray T. The front fingers are designated 20A and those adjacent the open rear end of the tray are designated 20B. As shown in FIG. 14, the fingers engage in a space between the guide rails 21A and 21B of the tray conveyor $C_t$ to stabilize the tray during movement along the conveyor. The fingers also trigger sensors to insure that the trays entering the tray loading station $S_l$ are in the proper attitude and disposition on the conveyor. The legs 20B are staggered as shown in FIG. 9 and the legs 20A are aligned in a transverse plane or direction so that the sensor discriminates forward and reverse positioning of the tray T on the conveyor.

Considering now the specific structural details and arrangement of the system and apparatus broadly described above and considering first the details of the vial infeed conveyor assembly $C_i$, these details are best shown FIGS. 4, 5 and 10–12 inclusive. As illustrated, the vial infeed conveyor $C_i$ comprises an endless belt 22 which moves in an endless path around a drive sprocket 34 and driven sprocket 36 by means of a motor and gear reduce $M_1$. The drive sprocket 34 is connected to the motor and gear reducer by chain 32. The vial conveyor $C_i$ includes a pair of upstanding elongated guide rails 37 defining a pathway P for presenting vials B in single file to the transfer station $S_t$. The guide rails 37 are mounted on blocks 38 which determine the width of the vial pathway P. When it is desired to change the width of the path P to accommodate vials of different diameter, the blocks 38 are changed. The blocks 38 are pre-gauged for vials of different diameters.

Figure 13:
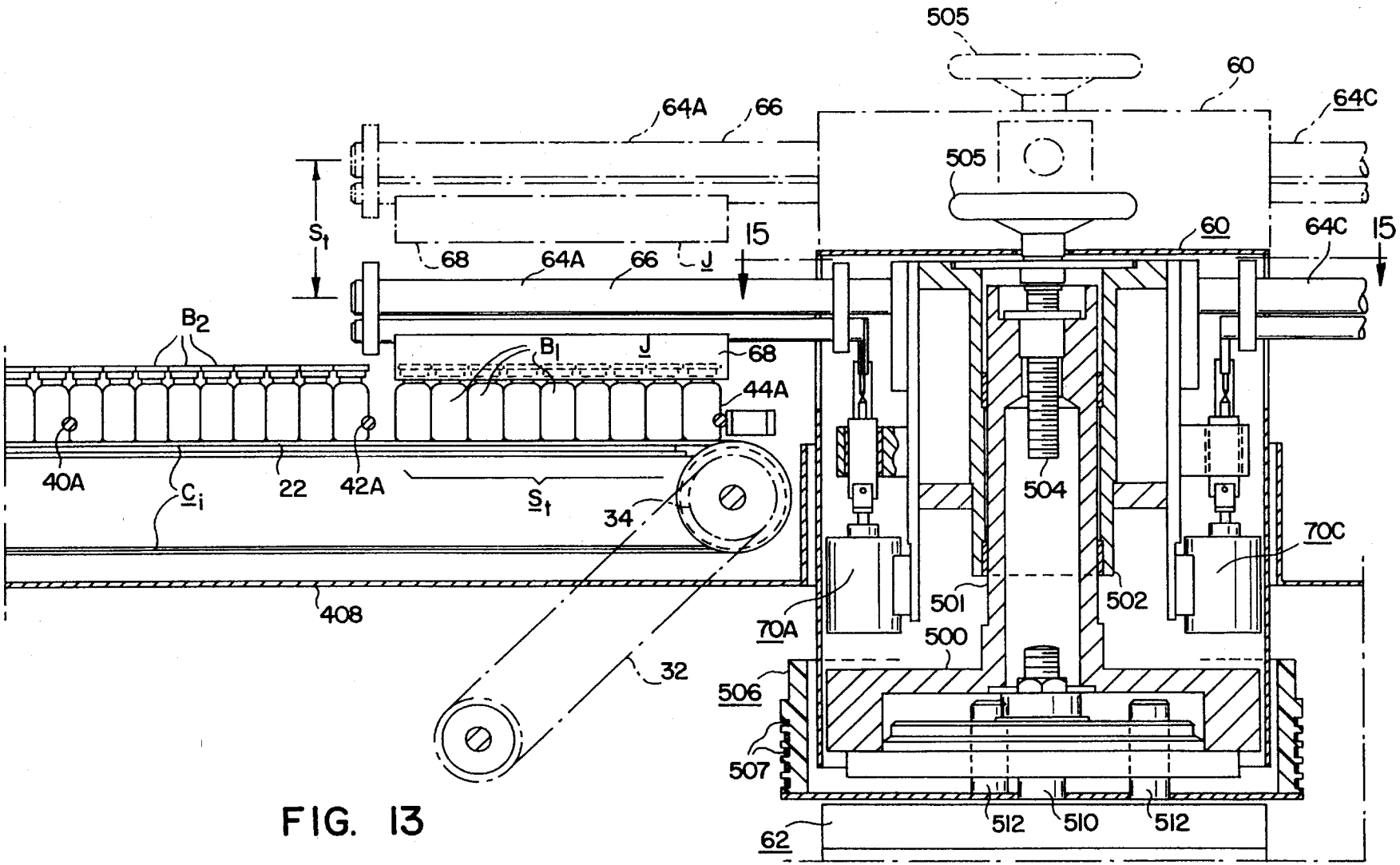
FIG. 13 is an enlarged fragmentary sectional elevational view taken on the line 13—13 of FIG. 4 showing details of the vial infeed conveyor, the turret assembly and drive connection to the output end of the CAMBOT device.

Escapement mechanism means $M_e$ are provided along the vial pathway P for controlling the number of vials delivered to the vial transfer station $S_t$ in groups. In the present instance, the escapement mechanisms $M_e$ comprise three solenoid operated gates 40, 42 and 44 located along the pathway P, having actuating pins 40A, 42A and 44A respectively, positionable in an extended position through the vial pathway P and a retracted position out of the pathway P permitting vials to move freely on the conveyor. With reference to FIG. 13, middle gate 42 is adjustable and is fixed along the pathway P in a predetermined position determined by the length of the gripper jaws J of the transfer mechanism to segregate a first group of vials $B_1$. Gate 40 is adjustable along the pathway P and is fixed relative to the gate 42 to determine the second group of vials $B_2$. The innermost gate 44 is mounted in a fixed position. The actuating pin 44A of gate 44 mounts a spring biased first stop 44B. A second adjustable spring biased stop 44, staggered relative to stop 44B, is mounted on rail 37 and functions as a dead stop. This system functions to permit alternate staggering of the rows of vials delivered to the tray T and facilitates nesting of the rows in a manner shown in FIG. 20. For example, with pin 44A in an extended position as shown in solid lines in FIG. 12, the lead vial of the row $B_1$ is stopped in the solid line position shown. When the pin 44A is retracted, the lead vial of the next row $B_2$ is in the dotted line position engaging dead stop 44.

Operatively associated with the gates are two sensors 46 and 48. Sensor 46 senses the presence of the row of vials $B_1$ at the transfer station $S_t$ and is operative to condition actuation of the transfer mechanism R. Sensor 48 senses the rows of vials $B_2$ preparing to move into the transfer station $S_t$. Considering the operation of the gates briefly, gate 42 is normally closed and gate 40 is normally open permitting vials B to flow into the pathway P between the gates to accumulate vials in rows $B_1$ and $B_2$ in the manner described. When a predetermined number of vials forming a first group $B_1$ enters the pre-transfer region of pathway P, gate 40 closes, and simultaneously gate 42 opens to allow group $B_1$ to move to the transfer station $S_t$. This operation is a continuous process, the gates 40 and 42 flip-flopping in the manner described to feed vials in predetermined groups to the transfer station $S_t$.

The vials forming row $B_1$ at the transfer station $S_t$, accumulated in the manner described above, are now ready for pick-up and transfer to the tray T. The structural details and arrangement of the transfer mechanism is best illustrated in FIGS. 3–5 and 13–16, inclusive. The transfer mechanism comprises a generally elongated cylindrical turret 60 adapted for rotational and axial displacement by means of a CAMBOT mechanism 62 which is a commercially known robotic actuating mechanism. Turret 60 mounts four circumferentially equi-spaced gripper arms 64A–64D. Each gripper arm includes an elongated arbor 66 and a pair of pivotally mounted gripper jaws 68 which engage under the bottle finish in the manner shown in FIG. 17A during a transfer cycle. The in turned ends of the gripper jaws 68 are preferably covered with a flexible material, such as plastic, to prevent damage to the vials B. The jaws 68 are pivoted between open and closed positions by actuators comprising a solenoid 70, scissor linkage 72 and return springs 74. The spring 74 normally maintains the jaws in a closed position. Energization of the solenoid 70 extends the scissor linkage 72 and opens the jaws 68 against the bias of the springs 74. The jaws 68 are disposed in an open or closed position depending on whether the transfer mechanism is in a vial pick-up mode or vial discharge mode. For example, when an arm 64A overlies the group of vials $B_1$ at the transfer station, the jaws 68A are open and when the turret 60 is in its lower limit position, the jaws 68A close under the finish of the vials of group $B_1$. The jaws 68A remain in a closed position as the turret 60 is raised and rotated to position the group of vials $B_1$ over the tray T at the tray loading station $S_l$. The jaws 68A open and release vials $B_1$ when the arm 64A reaches its lower limit position to deposit them in the tray T.

The repetitive actuating cycle of the turret 60 is as follows. The "home" position of the turret 60 is in the upper limit position shown in FIG. 5 with arm 64A aligned with the infeed conveyor $C_i$. The turret 60 includes four proximity sensors 80A–80D for sensing the position of the four (4) arms 64A–64D relative to the "home" position. The CAMBOT assembly 62 also includes a series of proximity sensors 82A, 82B and 82 arranged in a dial-like configuration and actuated sequentially by means of a rotating flag 84 mounted on the output shaft of the CAMBOT 62. Accordingly, when the CAMBOT positions the turret 60 in the "home" position, flag 84 registers with the sensor 82A. Sensor 82B energizes solenoid 70A and 70D for gripper arm assemblies 64A and 64D to position the jaws 68A and 68D in an open position and the solenoid 70B and 70 for gripper arm assemblies 64B and 64 remain de-energized and therefore the jaws 68B and 68 are closed. The CAMBOT device cycle then continues moving the turret 60 downwardly to its lower limit position and in this position the flag 84 registers with sensor 82B. In this position, sensor 82B signals solenoid 70A of arm 64A to close gripper jaws 68A embracing the row of vials $B_1$ at the transfer station $S_t$ for delivery. The solenoid 70B for gripper arm assembly 64B simultaneously is energized to release vials at the tray delivery station $S_l$. The CAMBOT mechanism 62 then returns turret 60 to its upper limit position moving flag 84 to register with proximity sensor 82 initiating cycling of the vial tray conveyor $C_t$ and rotating turret 60 through 90°.

Figure 19A:
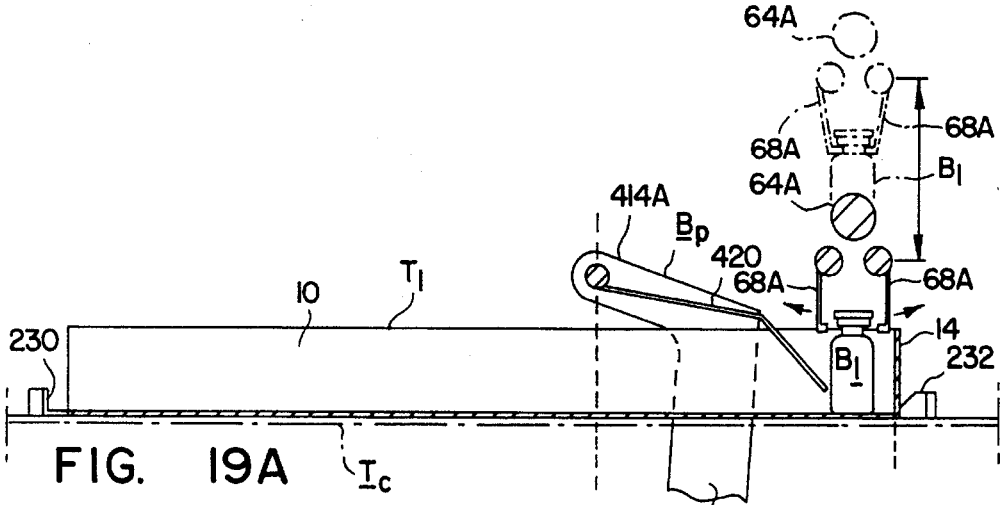
FIGS. 19A–19G schematically show the sequence of operations occurring at the tray loading station.
Figure 19B:
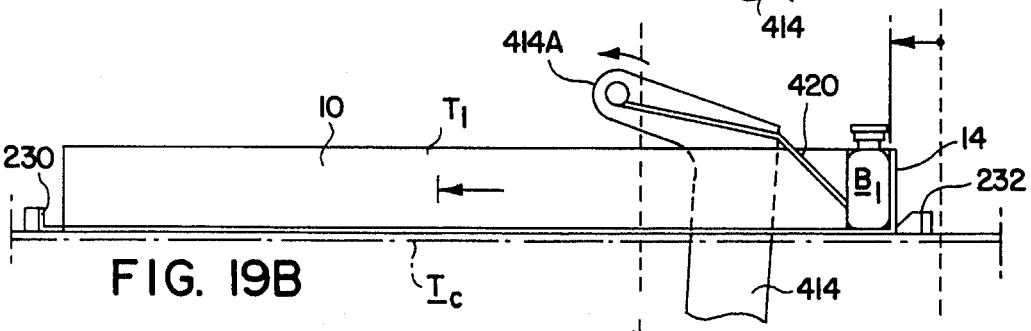
Figure 19C:
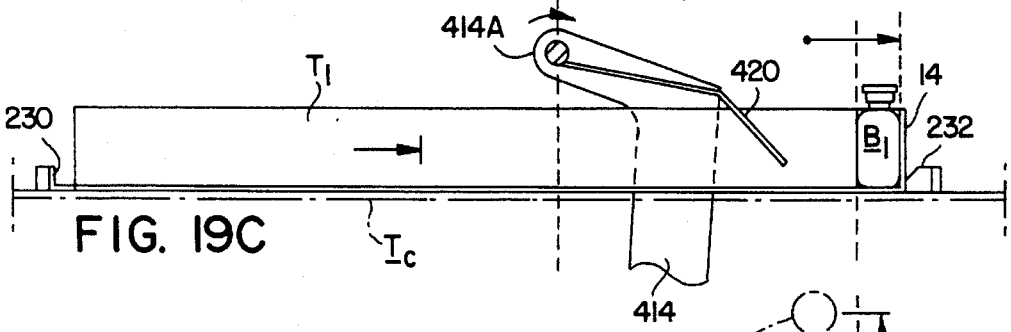
Figure 19D:
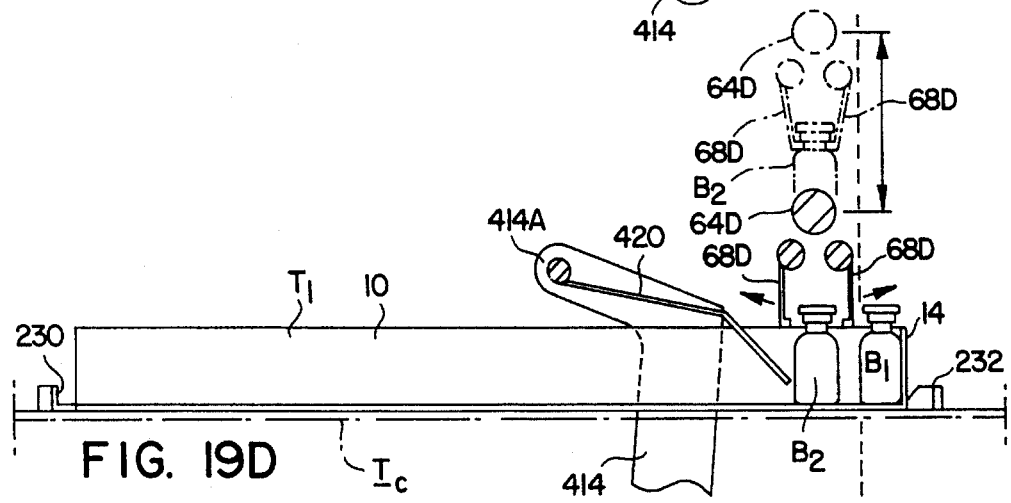
Figure 19E:
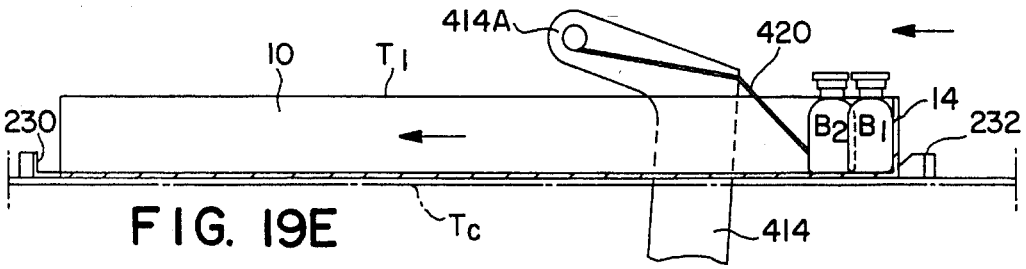
Figure 19F:
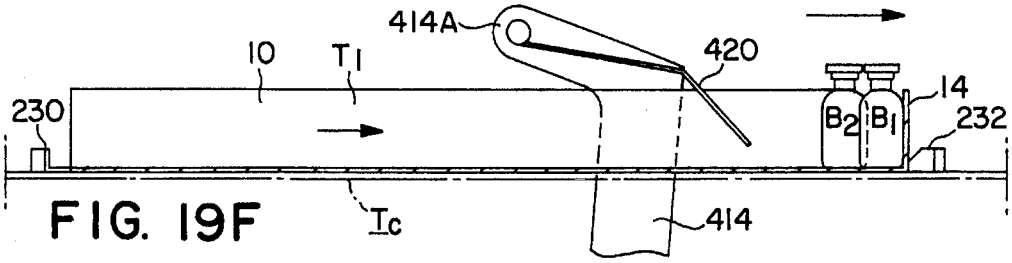
Figure 19G:
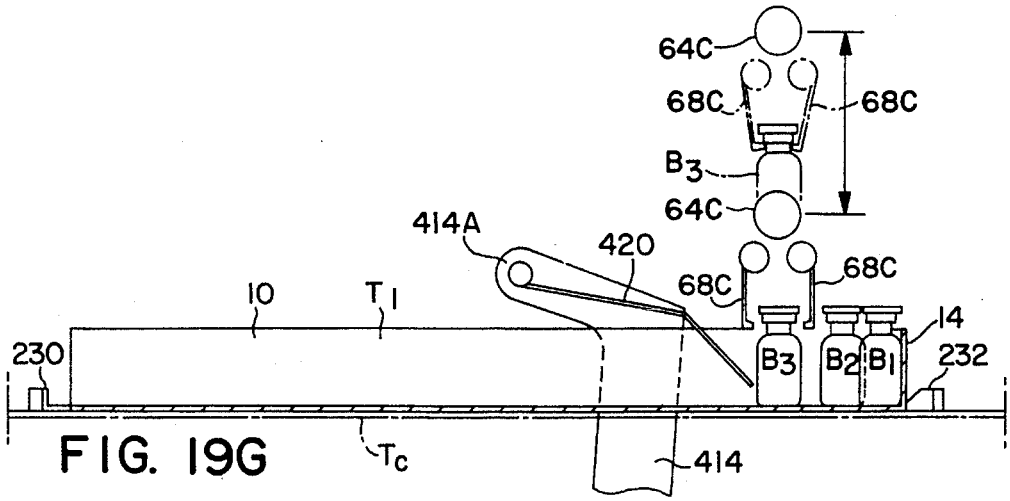

The tray loading section of the apparatus is best illustrated in FIGS. 3, 4, 7 through 9, and 14. Considering first the broad details of the tray loading section, there is provided an endless tray conveyor $C_t$ powered by a servo motor $M_s$ which can be selectively actuated forwardly or rearwardly through a programmable logic circuit (PLC). In a typical cycle of operation and with respect to the various schematic views of FIGS. 19A– 19G, inclusive, the conveyor $C_t$ delivers an empty tray T to the home tray loading position so that a first row of vials $B_1$ to be deposited in the tray T can be positioned in the tray with a predetermined clearance from the front wall 14 as illustrated in FIG. 19A. A pusher assembly 400 includes a compactor blade 420 after a row of vials $B_1$ is deposited on the tray, the conveyor $C_t$ is actuated rearwardly and in so doing the row of vials $B_1$ is urged by the blade 420 against the front wall 14 of the tray T as shown in FIG. 19B. Movement of the tray T rearwardly displaces the pivotally mounted rocker arms 402 of the pusher assembly which signals reversal of the conveyor $C_t$ and initiates a forward displacement a predetermined increment to create a space for the next row of vials $B_2$ to be delivered as illustrated in FIGS. 19 and 19D. When the next row of vials $B_2$ is delivered, they are staggered relative to the previous row $B_1$ in the manner described previously and as shown in FIG. 20.

Accordingly, when the conveyor $C_t$ is reversed to compact the vials just delivered, the pusher bar urges them into a nested configuration with the first row $B_1$. (See FIGS. 19E and 20). The cycle of filling, discharging, and compacting the rows $B_1$ and $B_2$ in the manner described above continues until a tray T is completely filled as shown in FIG. 20. When the tray has been filled to capacity as measured by the PLC, the conveyor $C_t$ is actuated forwardly to deliver the full tray T to a discharge position and advances the next adjacent empty tray T to the "home" position as shown in FIG. 19A. The filled tray is advanced to a downwardly inclined discharge ramp and moves slowly by gravity to a stop position on the discharge conveyor $C_d$ either engaging the ultimate stop at the end of the discharge conveyor or a previously filled tray ahead of it. These filled trays are then redirected or removed manually by operators.

Figure 7:
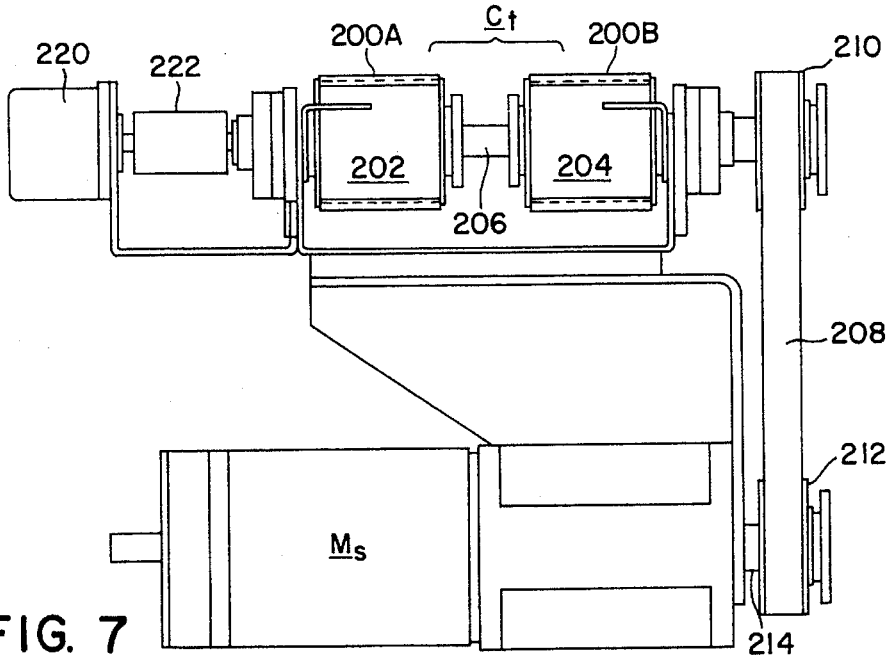
FIG. 7 is an enlarged transverse sectional view taken on the line 7—7 of FIG. 1 showing the drive means for positioning the tray conveyor belt.

Considering now the tray conveyor section more specifically, (See FIGS. 7–9, FIG. 14, and FIGS. 19A–20) the tray conveyor $C_t$ comprises two endless belts 200A and 200B of a predetermined width so that trays straddle the conveyor in the manner shown in FIG. 8. The inner surface of the belts have a toothed configuration to mesh with drive sprockets 202, 204 and provide a nonslip, high speed accurate positioning of trays necessary for accurate positioning and loading of vials in the manner described above. Drive sprockets 202 and 204 are mounted on a common shaft 206 which is connected by a belt 208 via pulleys 210 and 212 to the drive shaft 214 of a servo motor $M_s$. As illustrated in FIG. 7, the shaft 206 is connected to an encoder 220 by means of a flexible coupling 222. The conveyor belts 200A and 200B are connected by a series of spaced transversely extending tray retention cleats 230 and 232 which are spaced apart a predetermined distance equal to the length of a tray T as shown in FIGS. 8 and 9 so that a tray positioned between the cleats 230 and 232 nests snugly in place on the conveyor belts. Note that one of the cleats 232 has a beveled or angled edge 232A to facilitate positioning of the tray T and the cleats 230 are shaped to define a shelf 230A adjacent the rear open end of a tray T so that the last row of vials B can be deposited in spaced relationship to the previous row prior to being nested by the pusher bar. (See, for example, FIGS. 19D or 19G and 20)

Proper positioning of the trays T on the conveyor $C_t$ is important to insure the controlled sequence of operations described above. To this end, there are a number of sensors positioned along the conveyor $C_t$ for determining proper seating and orientation of the trays T on the conveyor. For example, a so-called high tray, or unseated, sensor 300 is located upstream of the tray "home" position at a predetermined small height above the upper edge of the side wall of a correctly seated tray T on the conveyor. Accordingly, if a tray T is cocked or out of position, it is detected by the sensor 300 and it stops operation of the conveyor $C_t$ and provides visual indicia to the operator indicating the tray T next to arrive at the "home" position is not fully seated and therefore would cause a problem during the filling operation. A sensor 302 reads the profile of the tray legs 20B. Accordingly, if a given tray T is flush on the conveyor but reversed, the sensor 302 will bypass the tray T and advance the conveyor until a correctly positioned tray is in the "home" position.

A sensor in the form of an infrared emitter 304 and detector 306 is located adjacent the tray loading station $S_l$ to sense the front edge of a tray coming into the "home" position. Interruption of the beam halts advance movement of the conveyor to correctly position a tray T in the proper "home" position and initiates operation of the CAMBOT device 62 to begin delivery of vials in the manner described above.

Figure 2:
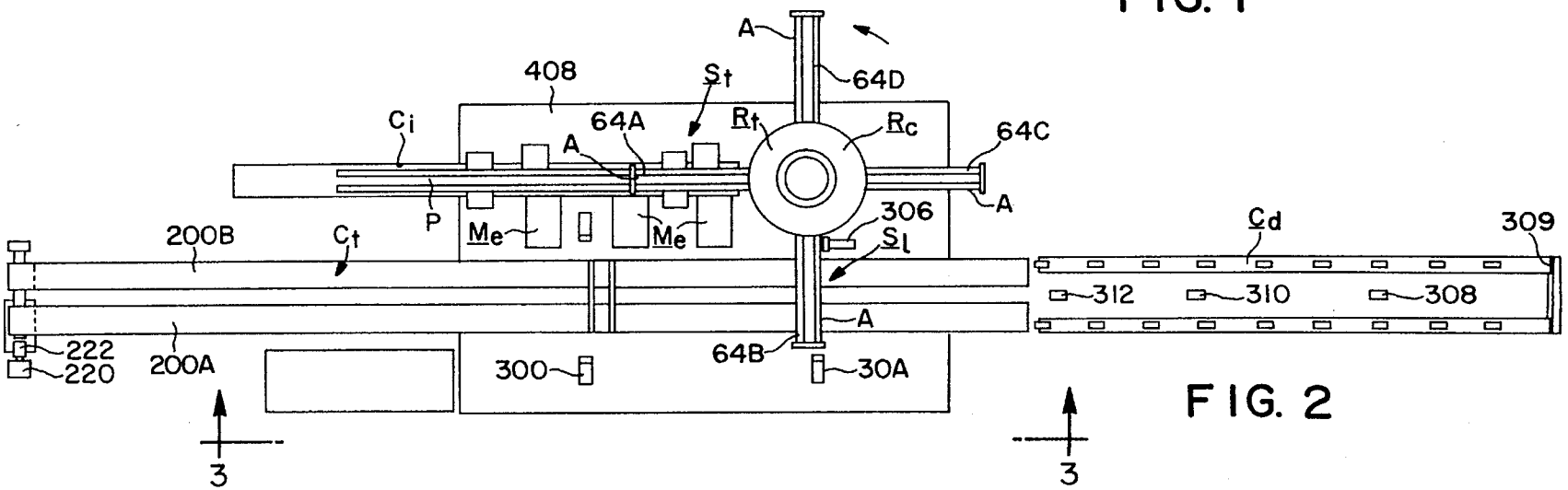
FIG. 2 is a plan view of FIG. 1.

A series of proximity sensors are located along the discharge conveyor $C_d$ (See FIG. 2). A first proximity sensor 308 senses a filled tray T abutting the stop 309 at the end of the discharge ramp and a second proximity sensor 310 senses a second filled tray T abutting the first filled tray. The proximity sensor 310 is connected to an audible alarm to signal the operator that a filled tray T needs to be removed from the discharge ramp. This sensor 310 simply initiates an audible alarm and does not interfere with the filling operation of the trays. The system includes a third proximity sensor 312 upstream from the first two sensors. If the discharge ramp is filled to this point, the third proximity sensor 312 will shut down further operation until filled trays are removed.

Figure 3:
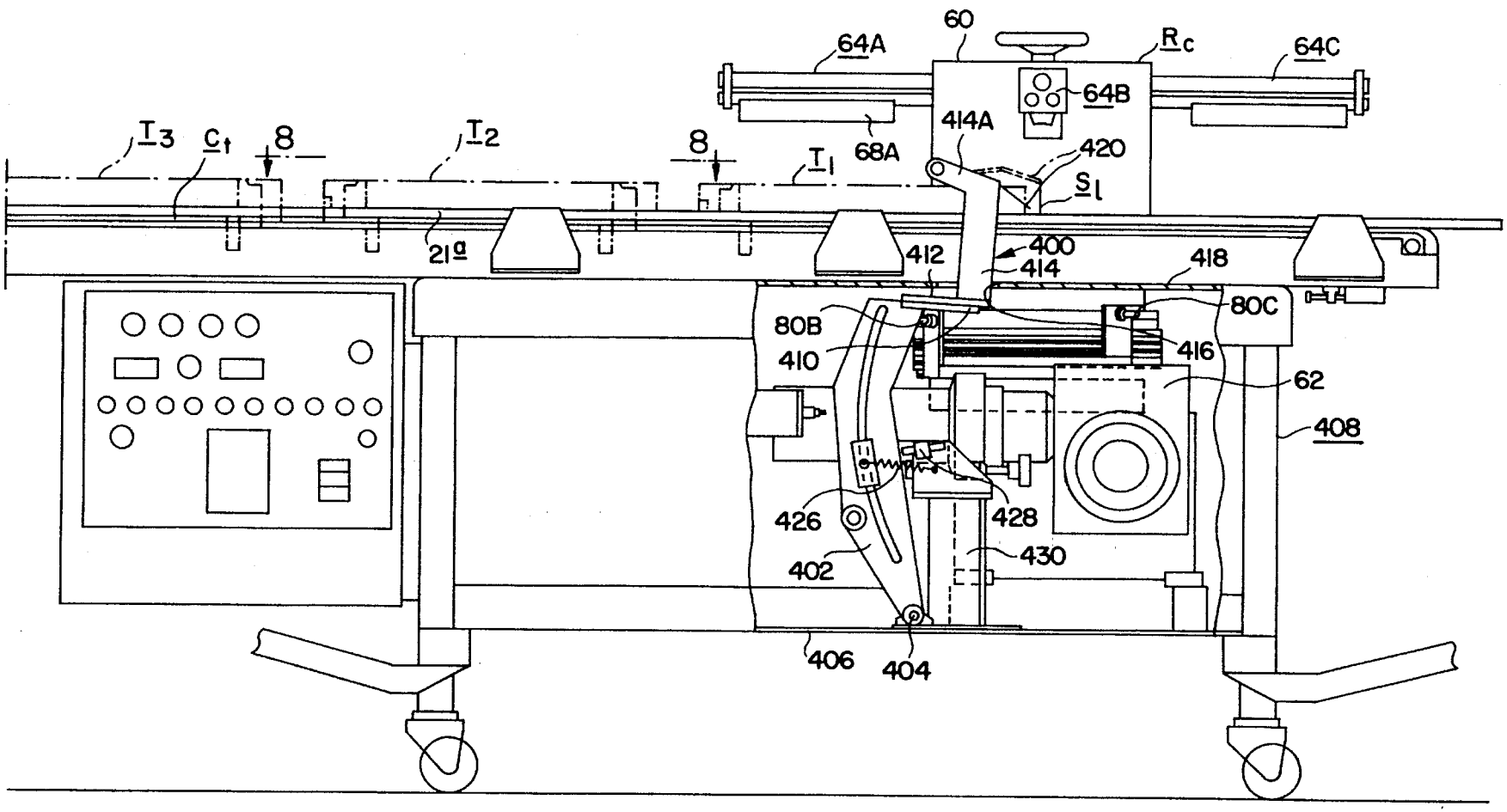
FIG. 3 is an enlarged fragmentary side elevational view taken on the line 3—3 of FIG. 2 with a portion of the four arm robotic tray loader table broken away to show details of the tray pusher assembly and compactor blade.
Figure 4:
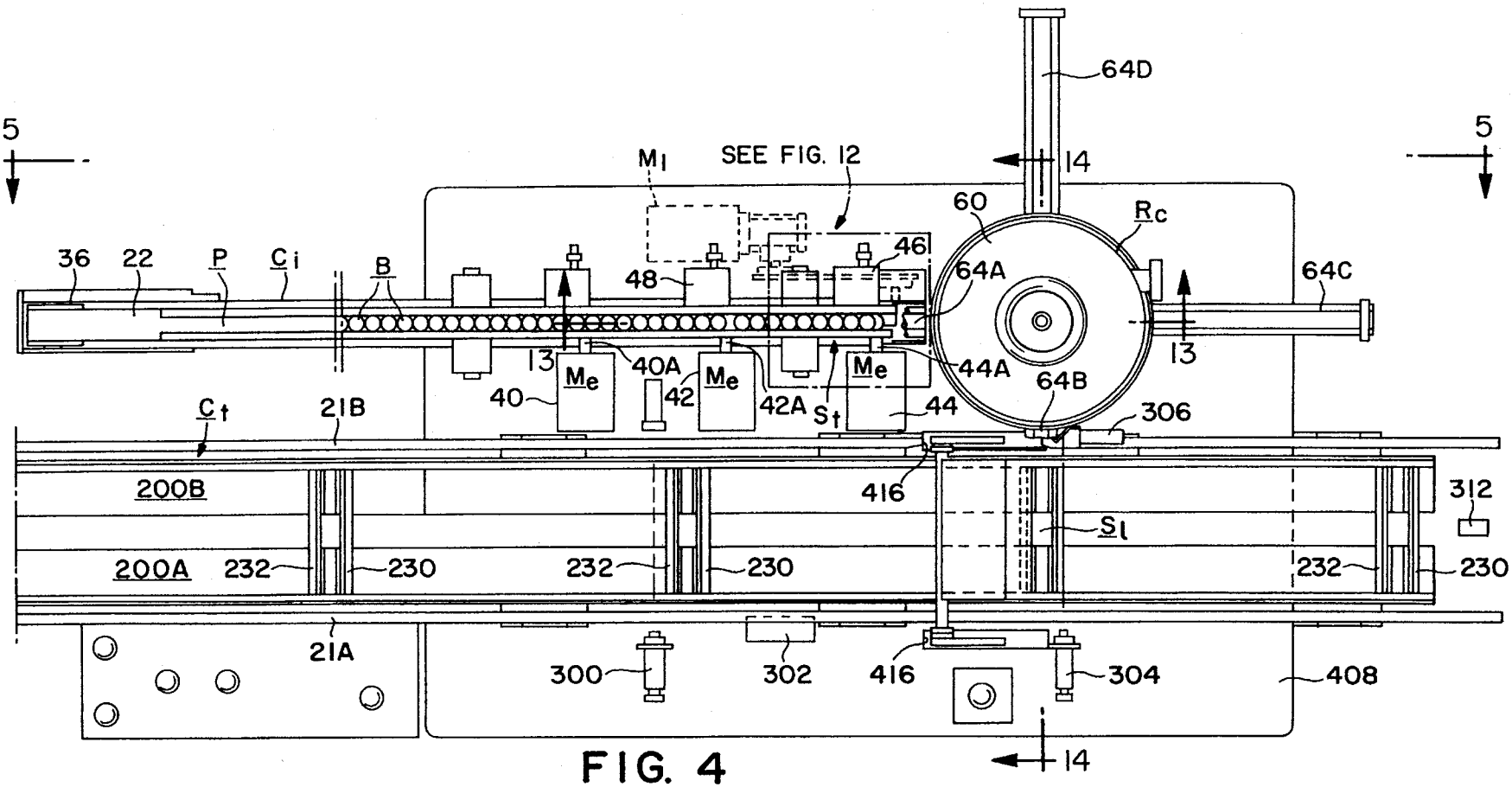
FIG. 4 is a plan view of FIG. 3 showing additional details of the vial infeed conveyor, turret and tray conveyor.
Figure 5:
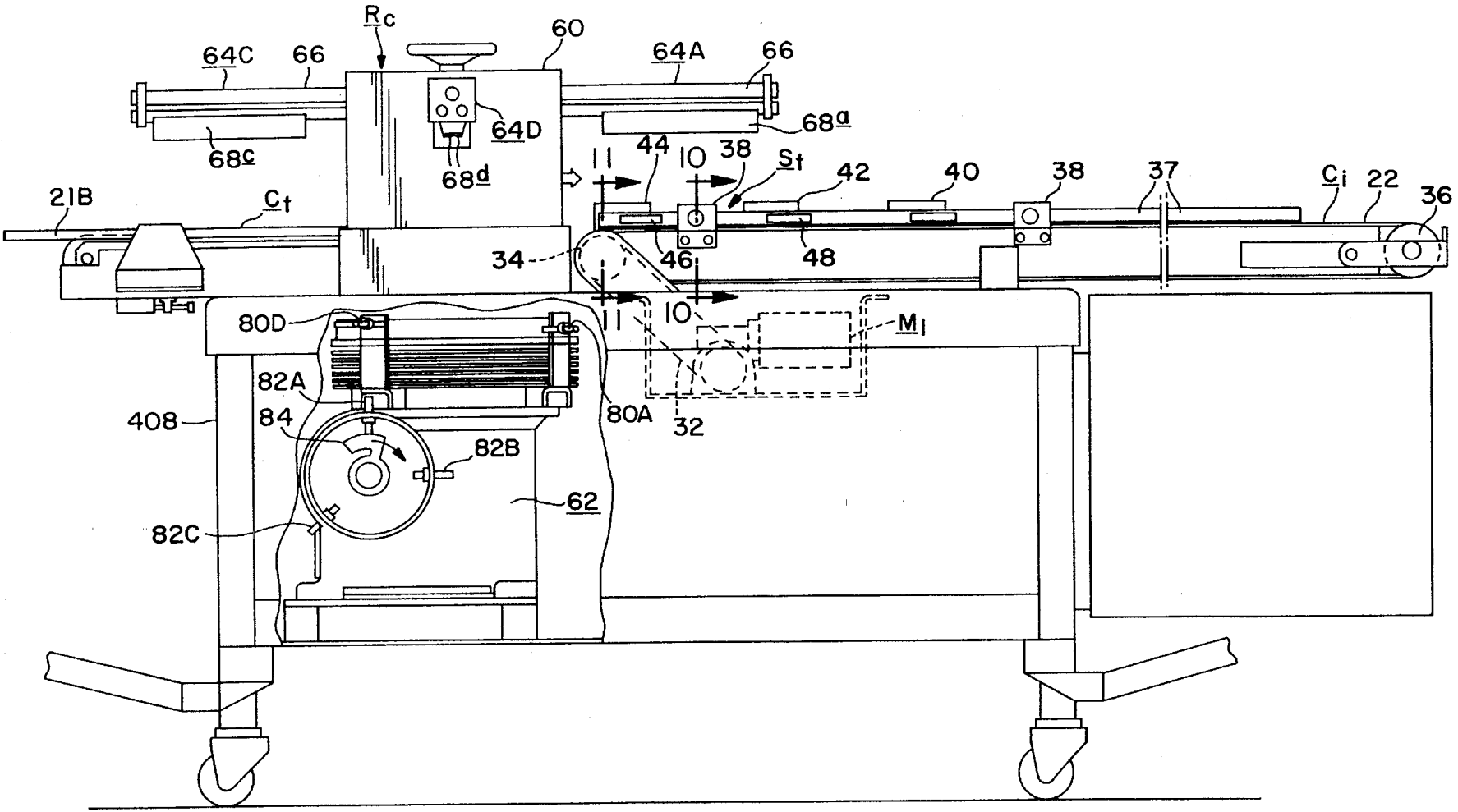
FIG. 5 is a side elevational view taken on the line 5—5 of FIG. 4 with a portion of the robotic tray loader table broken away to show details of the CAMBOT device and its associated turret assembly.
Figure 6:
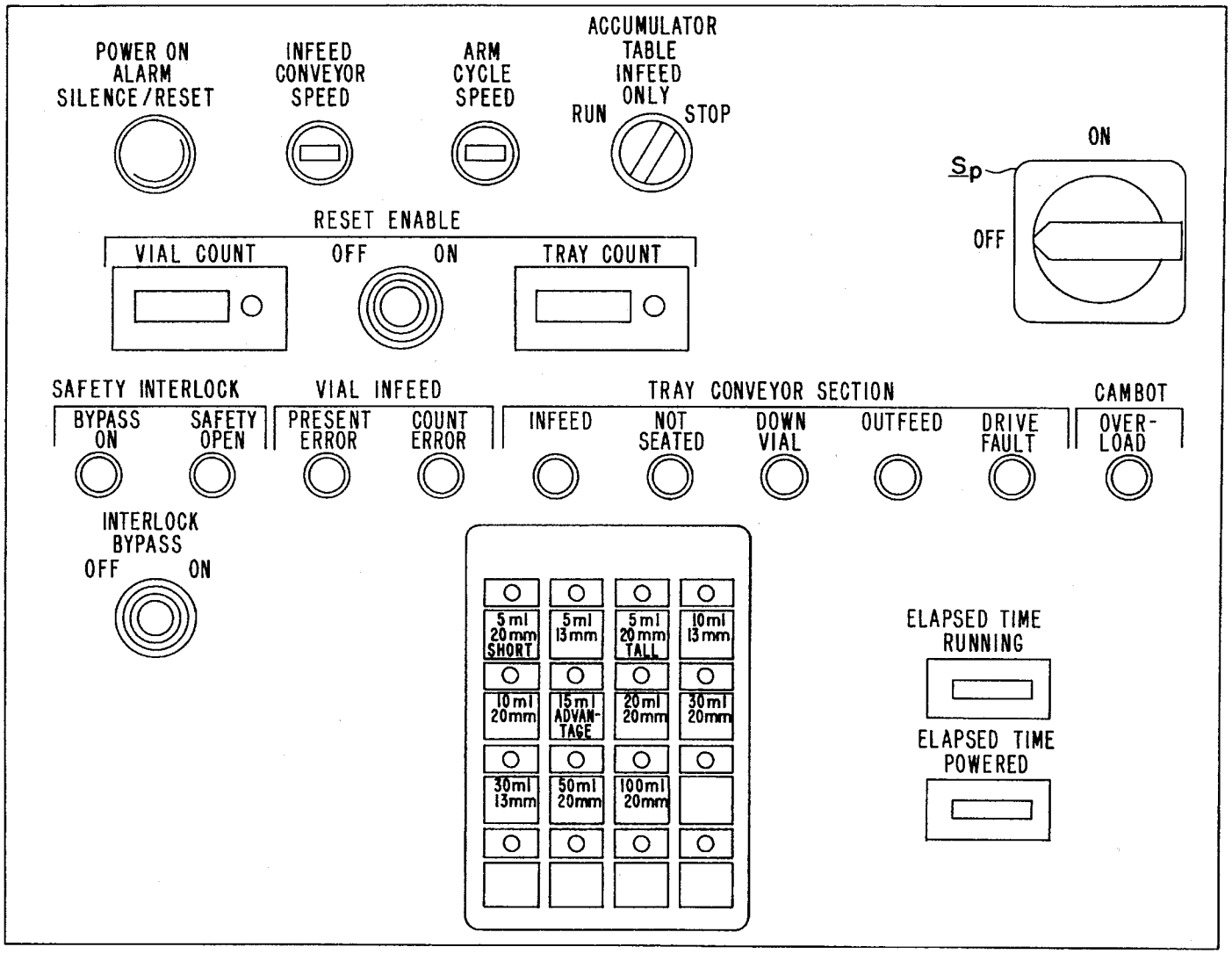
FIG. 6 is an enlarged view of the main control panel.

Consider now the specific details and operation of the spring biased pivotally mounted pusher arm assembly 400 (See FIGS. 3 and 4). The spring biased pusher bar assembly 400 comprises a pair of vertically extending rocker arms 402, pivotally mounted at their lower ends, as at 404, to the lower deck plate 406 of the main support table 408. The upper terminal ends of the rocker arms 402 are tied together by a cross plate 410 forming a generally inverted "U" shaped bracket. Arms 414, forming an extension of rocker arms 402, pass through slots 416 in the upper deck 418 of the main support table 408. Arms 414 straddle the tray conveyor. The upper terminal ends of the arms 414 have rearwardly extending portions 414A which pivotally support the compactor blade 420. The compactor blade 420 has a width slightly less than the inside width of the tray T and is centered to work within the side walls of the tray. The entire pusher bar assembly 400 just described is forwardly biased by means of a spring 426 into engagement with an adjustable proximity sensor 428 mounted on a pedestal 430 secured to the lower deck 406.

In operation, when the tray conveyor $C_t$ is driven in a reverse direction, the lead edge of the compactor blade 420 engages the vials $B_1$ opposing their oncoming motion causing the vials $B_1$ to slide along the tray bottom until the vials contact the end wall 14 of the tray or into nested contact with a previously compacted row of vials (See FIGS. 3 & 19A–19G). Continued rearward motion of the tray conveyor $C_t$ then causes the spring biased pusher arm assembly 400 to move away from the proximity sensor 428 signaling an immediate change in direction of conveyor $C_t$ to reposition the tray T in a precisely calculated position providing the necessary clearance for the next loading sequence (See FIG. 19A–19G). The spring biased pusher bar assembly 400 returns to its forwardly biased position against sensor 428.

The direction of travel of the tray conveyor $C_t$ is generated by the servo motor. How far the tray conveyor travels in either direction is determined by the diameter of the vials to be run and has been programed into the programmable logic circuit (PLC), and the exact distance of travel of the tray conveyor in either direction is measured by the encoder.

Consider now the operation of the method, apparatus and system of the present invention in processing vials B from a vial pickup or transfer station $S_t$ to a tray loading station $S_l$. As noted above, the system and apparatus of the present invention are designed to handle a wide variety of vials which differ in volume, diameter and height. Accordingly, the type of vial to be run is first entered into the programmable logic circuit (PLC) on the keyboard of the console and these conditions allow for automatic operation of the various mechanisms for processing vials in the manner described. Vials B to be run are randomly oriented at an accumulator station and are delivered by a vial conveyor $C_i$ single file to a vial pickup station $S_t$. Vial trays are positioned on the tray conveyor $C_t$. Gates 40 and 42 are positioned along the conveyor pathway P to separate the vials B in discrete groups $B_1$, $B_2$ for pickup by the transfer arms in successive cycles of the operation of the turret. For example, the length of the gripper blades of the pickup arms determines the number of vials B in the groups $B_1$, $B_2$. The position of gate 42 from the end stop 44B determines the number of vials B in group $B_1$, and the position of gate 40 from gate 42 determines the number of vials in group $B_2$.

The apparatus is now set for automatic operation and thus the main power switch $S_p$ on the console is engaged by the operator. The conditions for automatic operation include positioning of the turret 60 so that the arm 64A is aligned with the infeed conveyor $C_i$, and in this position the gripper jaws 68A are in an open position. It is noted that sensors 80A–80D, spaced about the periphery of the turret assembly 60, sense the position of each arm through 360° of rotation. Thus, when arm 64A overlies the vial infeed conveyor $C_i$, the turret 60 is in the "home" position and the CAMBOT device 62 is at the first phase of an actuating cycle. In this position, flag 84 on the CAMBOT output shaft registers with proximity sensor 82A.

The vial conveyor $C_i$ is now energized to deliver vials to the vial pick-up station $S_t$. When sensor 46 is activated, it signals the presence of a row of vials $B_1$ at the vial pick-up station $S_t$. Tray conveyor T is energized to position an empty tray T in a "home" position at the loading station $S_l$. The tray T is in the home position when the lead edge of the tray intercepts the beam from emitter 304 and detector 306.

Figures 18A, 18B, 18C:
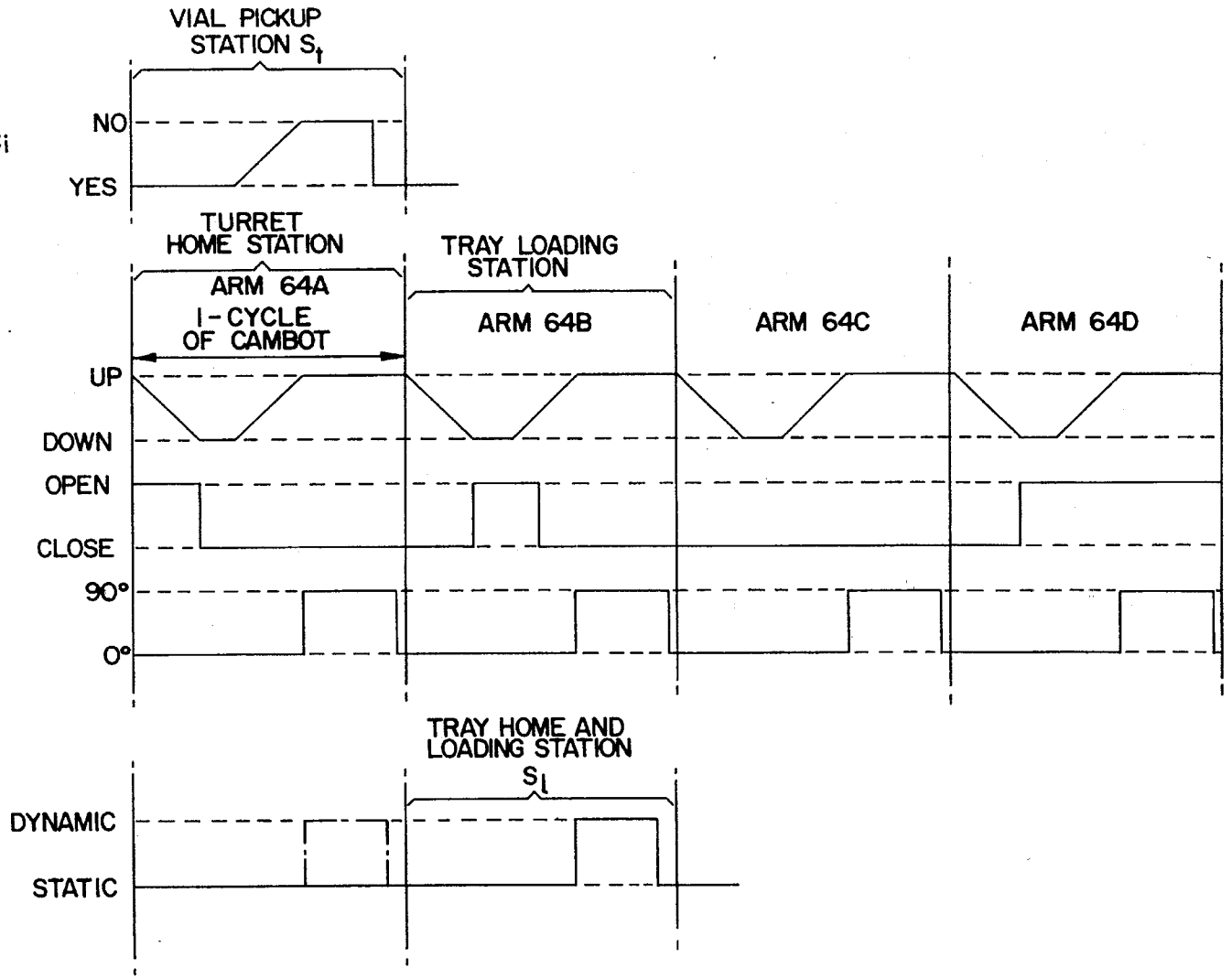
FIGS. 18A–18C are schematic timing diaphragms showing the related and timed action of the vial infeed conveyor at the pickup station, to the turret assembly at the home position, to the tray conveyor at the tray home loading station during one cycle of the CAMBOT device.

With a predetermined number of vials B at the pick-up station, the turret 60 is in its upper limit position with the arm 64A overlying the group of vials $B_1$, and, as noted above, an empty tray T is located in the "home" position at the loading station $S_l$. The CAMBOT device 62 initiates an operation cycle (See FIGS. 18A, 18B, and 18). In a typical cycle, the turret arm 64A moves downwardly with the gripper jaws 68A in an open condition and the solenoid 70A is energized to maintain the jaws 68A in an open position against the bias of springs 74. When the turret descends to its lower limit position, the gripper jaws 68A close to embrace group $B_1$ at the pick-up station $S_t$. In this position the CAMBOT device 62 is moved through 90° of its cycle and flag 84 of the CAMBOT device is aligned with proximity sensor 82B to signal the de-energization of solenoid 70A which closes gripper jaws 68A. Simultaneously, solenoids 70B and 70D are energized to spread gripper jaws 68B and 68D of arms 64B and 64D to an open position.

The cycle continues whereby the turret 60 is moved upwardly to its upper limit position to carry the first row of vials $B_1$ securely by the gripper jaws 68A. When the turret 60 reaches its upper limit position, the CAMBOT device 62 has moved through 225° of its cycle. In this position, flag 84 is aligned with sensor 82 which initiates cycling and positioning of the tray T to receive the row of vials $B_1$ with a predetermined clearance with the front wall 14 of the tray T. The turret then rotates through 90° to reposition the arm 64A over the tray conveyor $C_t$. During this portion of the cycle the next group of vials $B_2$ are advanced to the pick-up station $S_t$.

Again with reference to FIGS. 18A–18 inclusive, the first cycle of the CAMBOT device 62 ends with the turret 60 in the upper limit position wherein the arm 64A now extends transversely and overlies the empty tray T disposed in the "home" position at the loading station $S_l$. In this position, the row of vials $B_1$ is suspended above the tray T and the vials B are held firmly by the gripper jaws 68A. In this position the arm 64D now overlies the vial infeed conveyor $C_i$ at the vial pick-up station $S_t$, solenoid 70D being energized and thus the gripper jaws 68D are in a open position. The flag 84 of the CAMBOT device 62 again registers with proximity sensor 82A.

During the second cycle of the CAMBOT device 62, the group of vials $B_1$ is delivered to the tray T at the loading station $S_l$. Thus, at the start of the second cycle, the turret 60 of the CAMBOT device 62 moves downwardly from its upper limit position lowering the initial row of vials $B_1$ into the tray at the tray loading station $S_l$ (See FIG. 19A). It is noted that the stroke of the turret 60 between upper and lower limit positions is a constant and that the upper surface of the infeed conveyor belt $C_i$ is co-planar with the upper face of the tray bottom on the tray conveyor $C_t$. This insures that vials B delivered to the tray T are positioned gently in the tray by reason of the fact that the bottom face of the tray and the infeed conveyor $C_i$ are located in a common plane.

When flag 84 aligns with sensor 82B, the solenoid 70A is energized which moves gripper jaws 68A to an open position releasing the initial row of vials $B_1$ to the tray T at the tray loading station $S_l$. Simultaneously, solenoid 70D is de-energized, closing jaw 68D to engage the second row of vials $B_2$ at the vial pick-up station $S_t$. As the CAMBOT device 62 continues in its cycle, the turret 60 moves upwardly to its upper limit position and during this part of the cycle, solenoid 70A de-energizes closing gripper jaws 68A of arm 64A at the midpoint of its travel to the upper limit position.

When the turret 60 reaches its upper limit position, flag 84 is aligned with sensor 82 which initiates the compacting and advancing motions of the tray conveyor $C_t$. The turret 60 rotates 90° to position arm 64 over the vial pick-up station $S_t$ with gripper jaws 68 in an open vial engaging position and the arm 64D is positioned transversely relative to the tray T and tray conveyor $C_t$ with its gripper jaws 68D closed supporting the second row of vials $B_2$.

The cycling, or motions, of the conveyor $C_t$ and tray T supported thereon are controlled to precisely position the tray T under an arm of the turret 60 such that the closed end wall 14 of the tray T is advanced far enough to provide the necessary clearance for the opening of the gripper blades within the tray T during discharge of a row of vials to the tray T. This is defined as the "home" position of the tray T. Further, the compactor blade 420 of the pusher assembly 400 is adjusted for vials of different diameters to provide a small clearance and thereby avoid interference with the descending vials as they enter the tray T in the manner illustrated in FIG. 19A. The length of the tray T and the diameter of the vials being processed are programed into the PLC along with a factor to compensate for apparent change in vial diameter due to nesting of the vials in the staggered configuration. (See FIG. 20).

With the tray then in the "home" position, a first row of vials $B_1$ delivered to the tray T, and the turret 60 in its upper limit position, the flag 84 is aligned with the sensor 82C and initiates the tray conveyor $C_t$, vial compacting and advance sequence. More specifically, the servo motor $M_S$ drives the tray conveyor $C_t$ in a reverse direction so that the lead edge of the compactor blade 420 engages the vials $B_1$ and arrests the vials $B_1$ as the tray is moving rearwardly until the vials engage the front wall 14 of the tray T. At this point the compactor blade 420 is pivoted rearwardly initiating a forward drive of the conveyor, and the tray T is repositioned forward of the initial "home" position a predetermined controlled distance providing sufficient clearance for discharging the next row of vials $B_2$ and successive rows thereafter. The clearance for the next row of vials $B_2$ is shown in FIG. 19C. The travel distance of the conveyor $C_t$ forwardly and rearwardly is measured by the encoder 220 so that the PLC stores the available tray length remaining for the additional rows of vials. In this regard the rearward travel distance of the conveyor $C_t$ and the tray T is slightly greater for each of the compacting strokes after the first row of vial $B_1$ is compacted due to the nesting of the vials caused by the staggering of the rows of vials (See FIG. 20).

The apparatus continues to cycle to deliver vials B to the tray in the manner described above until the tray is full. The last row of vials $B_n$ is deposited on the L-shaped cleat 230A and the compacting stroke slides this row into engagement with the previously compacted row of vials thereby completely filling the tray (See FIG. 20). Thus the apparatus and method of the present invention insure complete filling of the trays thereby maximizing handling of vials.

The filled tray condition is preprogrammed into the PLC for each of the various vial types shown on the keyboard. Accordingly, when a tray is completely full, the PLC initiates advance of the tray conveyor $C_t$ to discharge the full tray to the discharge $C_d$ station and advances an empty tray T into the "home" position. The compactor blade 420, which is pivotally mounted, is merely pushed upwardly out of the way by the end wall 14 of the new advancing empty tray $T_2$ and falls back into operative position behind the end wall 14 when the new tray arrives at the "home" position.

The operation of the robotic tray loader described above continues automatically as long as vials are delivered to the vial pick-up station $S_t$ and empty trays T are supplied to the home position at the tray loading station $S_l$. It is noted that various safety interlocks are provided to trouble shoot the various operations and are displayed on the main console as lights or audible alarms. Also, emergency stop buttons are provided on the operator side of the loading table 408.

As noted above, the system, method and apparatus of the present invention are adapted for vials of different diameters and heights. To accommodate vials of different heights, the turret 60 is adjustable in a vertical direction relative to the conveyors. The vertical adjustment means is best shown in FIG. 13. Thus the turret 60 includes a base 500 mounted on the main shaft 510 of the CAMBOT device 62. The base having an elongated upstanding post 501 and a telescoping sleeve 502 slideably mounted on the post 501 which carries the arm assemblies 64A–64D. The sleeve 502 and arm assemblies 64A–64D are vertically moveable relative to the post 501 by means of a jack screw assembly 504 and adjustment wheel 506. The CAMBOT device 62 has locating pins 512 which engage in openings in the base 500 of the turret 60. As illustrated, the CAMBOT device 62 includes a shroud 505 having a plurality of slip rings 506 providing contacts for energizing the solenoids 70A–70D, inclusive. FIG. 13 shows the turret 60 in its lower limit positions (solid lines) and its upper limit positions (broken lines).

Even though particular embodiments of the invention has been illustrated and described herein, it is not intended to limit the invention, and changes and modifications may be made therein with the scope of the following claims.

What is claimed is:

1. In a system for transferring groups of containers from one location to another, a leading station including a transfer mechanism for continuously delivering rows of containers from the transfer station to a tray loading station, means at the tray loading station for cycling the tray in a predetermined controlled sequence to receive rows of containers delivered by the transfer mechanism and position them in compact array in the tray, a pusher arm assembly at the tray loading station, and means for selectively cycling the pusher arm relative to the tray to compact the rows of containers delivered to the tray and means for causing relative movement of said pusher arm and tray to compact the rows of containers delivered to the tray at the tray loading station into a compact array.

2. Apparatus transferring containers from one location to another including means for conveying containers to a transfer station and dividing them into groups of predetermined numbers, a transfer mechanism and means at said tray loading station comprising a turret having at least one radially directed arm assembly and moveable jaws actuatable between open and close positions to facilitate transfer groups of containers.

3. Apparatus as claimed in claim 2, wherein said jaws are normally biased to a closed position embracing the containers.

4. Apparatus as claimed in claim 2, including a series of escapement mechanisms positioned along said container conveyor which are adjustable to facilitate separation of containers into groups of predetermined numbers.

5. Apparatus transferring containers from one location to another including means for conveying containers to a transfer station and dividing them into groups of predetermined numbers, a transfer mechanism having means for transferring groups of containers to trays at a tray loading station, and means at said tray loading station for positioning said trays at a home position to receive rows of containers delivered thereto and a pusher arm assembly located at said tray loading station operable to compact rows of containers in said tray as they are delivered to the tray by said transfer mechanism.

6. Apparatus as claimed in claim 5, wherein said pusher assembly is pivotally mounted and means is provided to actuate said tray in a predetermined direction to effect compacting of rows of containers as they are delivered to said tray at said tray loading station.

7. Apparatus for transferring containers from one location to another including means for conveying containers to a transfer station and dividing them into groups of predetermined numbers, a transfer mechanism having means for transferring groups of containers to trays at a tray loading station, and means at said tray loading station for positioning said trays at a home position to receive rows of containers delivered thereto, means for selectively moving the trays relative to a pusher assembly at the tray loading station to compact the rows of containers delivered to the tray.

8. A method for handling containers consisting of the steps of;

a. grouping containers in a single file in predetermined groups;

b. transferring groups from a vial loading station to a tray loading station;

c. positioning trays at a tray loading station to receive the groups of vials; and d. cycling said trays in a predetermined controlled manner to compact said groups of containers in a predetermined compact array, wherein said cycling step includes the step of moving the tray rearwardly after a group of vials has been positioned in the tray to engage a spring biased pusher assembly to compact the containers in the tray and reversing the direction of movement of the tray thereafter to reposition said tray in a new location to receive the next group of containers delivered.

9. In a system for transferring groups of containers from one location to another, a loading station including a transfer mechanism for continuously delivering rows of containers from the transfer station to a tray loading station, means at the tray loading station for cycling the tray in a predetermined controlled sequence to receive rows of containers delivered by the transfer mechanism and position them in compact array in the tray and a pivotally mounted pusher arm assembly at the tray loading station operable to compact rows of containers delivered to the tray upon movement of the tray relative to the pusher arm assembly to effect compact positioning of the containers in rows relative to one another in the tray and including means for moving the tray to a new home position after a compacting cycle.

10. In a system as claimed in claim 9, including an infeed conveyor for delivering containers single file to a loading station and including a series of escapement mechanisms along said infeed conveyor to segregate the containers into at least two groups of containers of a predetermined number.

11. In a system for transferring groups of containers from one location to another, a leading station including a transfer mechanism for continuously delivering rows of containers from the transfer station to a tray loading station, means at the tray loading station for cycling the tray in a predetermined controlled sequence to receive rows of containers delivered by the transfer mechanism and position them in compact array in the tray, a pusher arm assembly at the tray loading station, and means for selectively cycling the pusher arm relative to the tray to compact the rows of containers delivered to the tray.

12. In a system as claimed in claim 11 including means for controlling the movement of the tray in said opposite direction to thereby provide means for controlling the predetermined increment so that the system can accommodate containers of different sizes and diameters.

13. A system as claimed in claim 11 including means for counting the number of rows of containers for a given sized tray and means responsive to the counting means for discharging a filled tray from the tray loading station and positioning the next tray in line to receive the first row of containers in the next cycle of operation of the system.

14. Apparatus as claimed in claim 11 wherein the pusher arm is normally spring biased to a first limit position and is cooperatively associated with a sensing means for activating the tray conveyor to cycle the tray when the pusher arm is displaced from said first limit position.

15. Apparatus as claimed in claim 11 wherein containers are fed single file to said transfer station and including two staggered stops at the transfer station whereby alternative groups engage the stops successively so that successive rows of containers delivered to the tray loading station are in a staggered array.

16. Apparatus for transferring containers from one location to another including means for conveying containers to a transfer station and dividing them into groups of predetermined numbers, a transfer mechanism having means for transferring groups of containers to trays at a tray loading station, and means at said tray loading station for positioning said trays at a home position to receive rows of containers delivered thereto, means at said transfer station for selectively controlling formation of the groups of predetermined numbers of containers whereby successive groups of containers are arranged in staggered rows at said tray loading station.

17. A method for handling containers consisting of the steps of:

(a) grouping containers in a single file in predetermined groups;

(b) transferring groups from a vial loading station to a tray loading station;

(c) positioning trays at a tray loading station to receive the groups of vials;

(d) cycling said trays in a predetermined controlled manner to compact said groups of containers in a predetermined compact array; and (e) first moving the tray in one direction an undetermined amount to engage a row of containers delivered against a pusher arm and then moving the tray in an opposite direction a predetermined increment to define a space in the tray large enough for the next row of containers to be delivered.

* * * * *